United States Patent [19]

Lavorel

[11] Patent Number: 4,910,989

[45] Date of Patent: Mar. 27, 1990

[54] PROCESS FOR MAKING AN EXTERIOR BEVEL ON A STAMPED CYLINDRICAL PART

[75] Inventor: Gerard Lavorel, Pringy, France

[73] Assignee: Ateliers de Decoupage, Emboutissage et Mecanique de la Vallee de L'Arve ADEMVA, Cluses, France

[21] Appl. No.: 332,564

[22] Filed: Apr. 3, 1989

[30] Foreign Application Priority Data

Apr. 6, 1988 [FR] France ..... 88 04971

[51] Int. Cl.[4] ..... B21D 28/00

[52] U.S. Cl. ..... 72/333; 72/347; 72/356; 72/379

[58] Field of Search ..... 72/327–329, 72/333, 335, 336, 347, 356, 379; 413/71

[56] References Cited

U.S. PATENT DOCUMENTS

| | | | |
|---|---|---|---|
| 161,634 | 4/1875 | Patterson | 72/333 |
| 448,748 | 3/1891 | Comings | 72/347 |
| 2,321,085 | 6/1943 | Hubbard | 72/327 |
| 2,415,940 | 2/1947 | Eckstein | 72/347 |
| 2,611,475 | 9/1952 | Slater | 72/347 |
| 3,406,554 | 10/1968 | Frankenberg | 72/333 |
| 4,534,201 | 8/1985 | LaRosa et al. | 72/348 |

FOREIGN PATENT DOCUMENTS

| | | | |
|---|---|---|---|
| 1932139 | 1/1971 | Fed. Rep. of Germany . | |
| 590053 | 1/1978 | U.S.S.R. | 72/336 |
| 1016008 | 5/1983 | U.S.S.R. | 72/356 |

*Primary Examiner*—Daniel C. Crane

*Attorney, Agent, or Firm*—Emch, Schaffer, Schaub & Procello Co.

[57] ABSTRACT

The invention is for the process for making an exterior bevel at a predetermined angle on a stamped cylindrical cup member. First a truncated stamped part having a predetermined angle is made. An axial cut is made on the periphery of the main body of the part. Lastly the side is straightened.

5 Claims, 2 Drawing Sheets

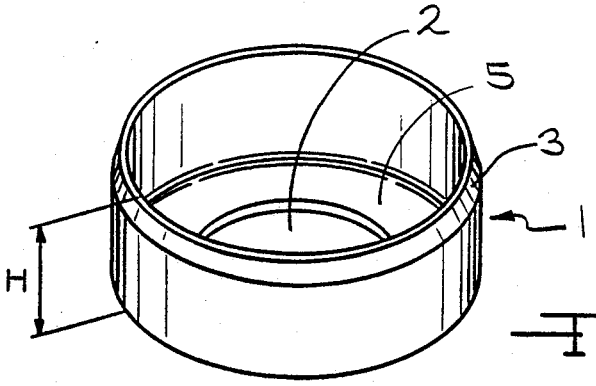
FIG. 1
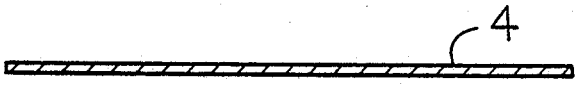
FIG. 2
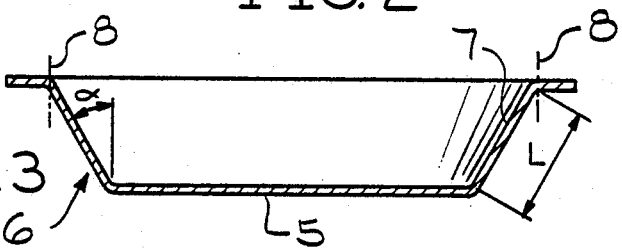
FIG. 3
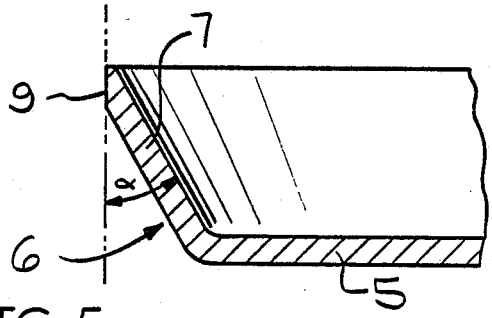
FIG. 4
FIG. 5
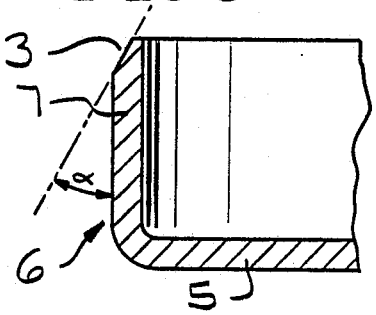
FIG. 6
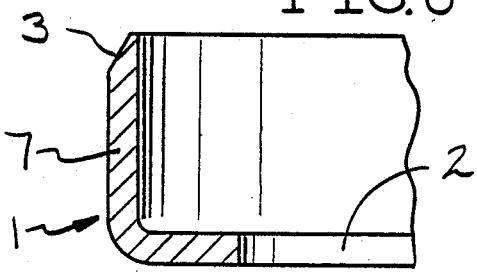

PROCESS FOR MAKING AN EXTERIOR BEVEL ON A STAMPED CYLINDRICAL PART

BACKGROUND OF THE INVENTION

The present invention relates to a process for making an outside bevel on a stamped cylindrical part.

In order to facilitate putting a stamped cylindrical part in a bore, it is necessary that the cylindrical part have a bevel on the entire outside periphery. Otherwise, putting the stamped cylindrical part in its related bore can be impossible because of irregularities, however minimal they may be.

Such an outside bevel is traditionally made by a tool which removes shavings in sufficient quantity in order to make the bevel. That traditional solution is very expensive. It is necessary, in fact, to include in the manufacturing process a stock room for stamped parts that are not yet beveled. Then the parts are transferred to the turning lathe for removing metal and making the bevel. Next, those same parts have to be cleaned through a particular process. The series of special operations increase the net cost considerably.

SUMMARY OF THE INVENTION

The invention seeks to remedy those disadvantages. It relates to a process for making an outside or exterior bevel on a stamped cylindrical part. The present invention includes starting with a flat metallic part and:

making first of all a prestamped conical shape of the part using a die whose tip has a conical shape with an angle equal to that of the bevel to be made;

next axially cutting the outside periphery of the truncated tip by a vertical cutting movement, for example;

and straightening next, by a final stamping, the truncated lateral surface of the stamped part in order to obtain a cup member with a coaxial surface whose edge has an outside bevel.

The invention will be well understood and its advantages and other characteristics will emerge from the following non-restrictive description of one example of a preferred embodiment.

DESCRIPTION OF THE DRAWINGS

FIG. 1 is a view of the part to be made;

FIGS. 2 to 6 show the successive phases for making the part by the process of the invention;

DESCRIPTION OF THE PREFERRED EMBODIMENT

Figure 7:
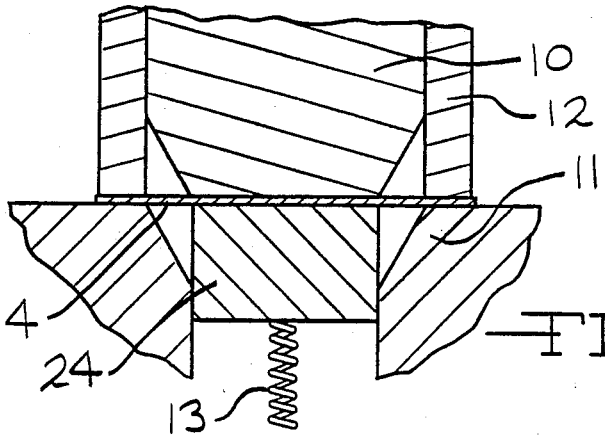
FIGS. 7 to 9 show the three tools used in the three successive phases essential in the execution of the process.

Referring to FIG. 1, the part 1 to be made is a cup member whose bottom is bored with an opening 2 for the passage of a drive shaft, and whose edge has an outside bevel 3. The bevel 3 is indispensable for putting the cup member 1 in a related bore.

FIGS. 2 to 6 show the successive phases essential in fabricating the cup member 1.

The first operation (FIG. 2 ) is carried out at a first station. It consists in cutting out, in a very traditional way between die and die bed, a metallic disc 4 with a diameter clearly greater than that of the cup member 1.

The disc 4 is then transferred to another station where a conical stamping of the disc 4 is made (FIG. 3) with the angle $\alpha$ at the top of the stamped cone equal to the bevel to be made. The tool is shaped so that the small base 5 of the main body of the cone 6 is made the same diameter as the bottom of the cup member 1 to be made, and its side 7 has a length L equal to the height H (FIG. 1) of the cup member 1.

The cone 6 is then transferred to another station containing a cutting device with circular periphery which cuts the truncated stamped core 6 in a vertical direction, indicated in FIG. 3 by the dashed line and the reference number 8.

The result is represented in a partial and enlarged view in FIG. 4. The outside edge 9 of the stamped cone 6 forms an angle $\alpha$ equal to that of the bevel to be made.

The stamped cone 6 is then transferred to a fourth station where its side 7 is straightened axially, that is, vertically. The side 7 then becomes ciruclar, cylindrical and perpendicular at the base or bottom 5 of the stamped cone 6. The side 7 thus has an outside bevel 3 with the angle $\alpha$ desired.

The cone part 6 is next optionally moved to a calibrating station, then on to a last station (FIG. 6) where the central hole 2 is made in the base 5, through which the drive shaft passes.

Since the tools used for cutting the disc 4 (FIG. 2) and making the hole 2 (FIG. 6) are traditional tools, they are consequently not illustrated.

FIG. 7 shows the tool used for stamping the truncated cone part 6 from the disc 4, as seen in FIG. 3. This tool includes a truncated die 10 and complementary die bed 11. A traditional side press 12 secures the periphery of the disc 4 during the stamping and prevents it from crumpling or wrinkling. Also traditional is a driver 24 and axial spring 13 which are parts of the die bed 11.

Figure 8:
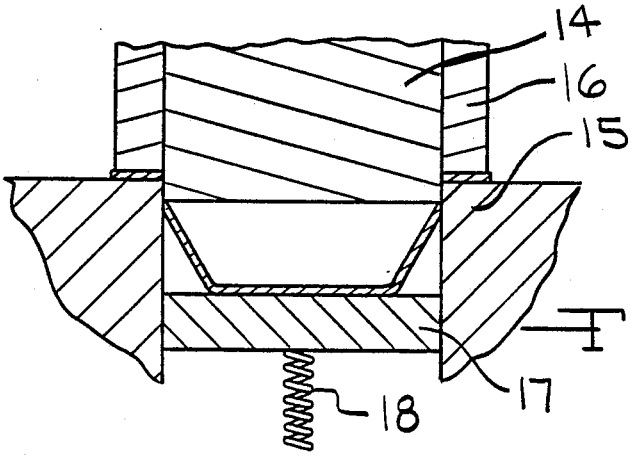

The tool used for axially cutting the periphery of the stamped part 6, as seen in FIG. 4, is illustrated in FIG. 8. It consists of a circular cutting tool with a circular cylindrical tip 14, a die bed 15, a side press 16, a driver 17 and a spring 18.

Figure 9:
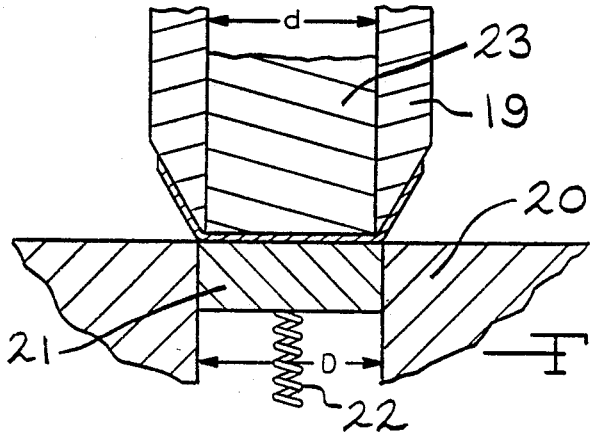

The tool used for straightening the part, as seen in FIG. 5, is illustrated in FIG. 9. It includes a beveled side press 19, a circular cylindrical die bed with a diameter D equal to the outside diameter of the cup member 1 to be made, a drive 21, a spring 22 and a circular cylindrical tip 23 with a diameter D equal to the inside diameter of the cup member 1 mentioned.

It goes without saying that the invention is not limited to the preferred method of production just described. Other embodiments of methods are possible within the framework of the following claims.

I claim:

1. A process for making an exterior bevel of a determined angle on a stamped cylindrical part, starting with a flat metallic part, the steps comprising:

making a stamped conical cup shape from the flat part using a first die so that the side wall forms interior and exterior sidewall surfaces of conical shape having an angle equal to that of the bevel to be made;

axially cutting the conical side wall of the stamped part around its exterior periphery; and after cutting, straightening the conical side wall of the stamped part thereby forming a cylindrical cup member with a coaxial surface having an edge at the rim of the cup member with an exterior bevel of the determined angle.

2. A process according to claim 1, in which the conical side wall has a length equal to the height of the cup member to be made, and the base of the stamped conical shape has a diameter equal to that of the bottom of the cup member being made.

3. A process according to either claim 1 or 2, in which the three steps of the process are successively completed at three different stations, each having a die and die bed.

4. A process according to claim 3, in which the first step is completed by a stamping process between the first die and a truncated die bed, wherein the second step is completed by a second die and die bed producing a vertical cutting movement, and the third step is completed by using a beveled side press, a cylindrical third die and die bed, with the third die having a diameter smaller than the diameter of the die bed.

5. A process according to claim 3 including the transfer of parts from one station to the next.

* * * * *